United States Patent [19]

Barclay et al.

[11] Patent Number: 4,664,389

[45] Date of Patent: May 12, 1987

[54] TOY CAR AND METHOD OF UTILZING SAME

[75] Inventors: David F. Barclay, Nevada City; Lee F. Glass, Albany, both of Calif.

[73] Assignee: Barclay Precision Toys Inc., Burton, Ohio

[21] Appl. No.: 785,496

[22] Filed: Oct. 8, 1985

[51] Int. Cl.[4] ..... A63F 9/00; A63H 18/00

[52] U.S. Cl. ..... 273/343; 273/1 GG; 273/58 D; 446/124; 446/228

[58] Field of Search ..... 273/1 G, 1 GC, 1 GG, 273/140, 58 D, 58 K, 351, 343; 446/228, 229, 120, 124, 125; 428/8, 9, 11

[56] References Cited

U.S. PATENT DOCUMENTS

| | | | |
|---|---|---|---|
| 1,703,438 | 2/1929 | Wilson et al. | 428/8 |
| 2,616,199 | 11/1952 | Robins | 428/9 |
| 3,331,153 | 7/1967 | Woods | 446/229 |
| 3,693,290 | 9/1972 | Breslow et al. | 273/351 X |
| 3,836,142 | 9/1974 | Baker | 273/1 GC |
| 4,177,991 | 12/1979 | Meyer et al. | 273/351 X |
| 4,183,169 | 1/1980 | Murphy | 446/228 |

FOREIGN PATENT DOCUMENTS

| | | | |
|---|---|---|---|
| 336915 | 2/1904 | France | 273/343 |
| 24767 | 11/1907 | United Kingdom | 273/58 D |

*Primary Examiner*—Paul E. Shapiro

*Attorney, Agent, or Firm*—Baldwin, Egan & Fetzer

[57] ABSTRACT

A toy car adapted for movable mounting on an elongated line and having a body with pulleys secured to the body for suspending the car from the line, and with a grappling hook depending from the body and adapted for picking up and retaining an open framework target during movement of the car along the lengthwise extent of the line. A method of moving the car along the line by manipulating the line to cause the car to move by gravity lengthwise of the line and to grapple the target object is also disclosed. The grappling hook structure is preferably detachable from the body.

12 Claims, 14 Drawing Figures

TOY CAR AND METHOD OF UTILZING SAME

This invention relates in general to a toy car having means thereon, such as pulleys, for suspending the car from an associated elongated line, with the car being adapted to move along the lengthwise extent of the line responsive to manipulation of the line, and with the car including grappling means thereon adapted for picking up and retaining a target object during movement of the car along the line. A novel method for grappling an object utilizing the car of the invention in connection with manipulation of the line is also disclosed.

BACKGROUND OF THE INVENTION

In the copending U.S. design patent application Ser. No. 641,317 in the name of David F. Barclay, filed Aug. 16, 1984 and entitled "Design for Toy Racing Car", there is disclosed a toy car which is adapted for movement by gravity along a line responsive to manipulation of the line by an operator. However, that type of toy car has no means for grappling an object, or target. It is adapted for movement along the lengthwise extent of the line and may be used in racing with like cars mounted on an adjacent operator controlled line.

SUMMARY OF THE INVENTION

The present invention provides a car of the general type of the aforementioned copending design patent application, but which includes means thereon providing for grappling of an object, such as an open framework target, during movement of the car along the lengthwise extent of the line, together with a method for grappling or picking up an object utilizing the grappling means on the car, responsive to manipulation of the car mounting line by an operator.

Accordingly, an object of the present invention is to provide a novel toy car adapted for mounting in suspended relationship on a flexible line which is adapted to be manipulated by an operator for causing movement of the car along the lengthwise extent of the line, with the car including grappling means thereon for snaring or picking up a target object.

Another object of the invention is to provide a toy car of the latter type wherein the grappling means includes means for grappling or snaring a target object during movement of the car in either direction lengthwise of the line.

A still further object of the invention is to provide a toy car of the aforementioned type wherein the grappling means comprises a hook-like member together with means detachably coupling the hook-like member to the car, so that the car can be utilized either with or without the grappling means.

A still further object of the invention is to provide a toy car of the aforementioned type in combination with a target object which comprises an open framework of interengaging rib-like elements which facilitates the picking up of the target object by the grappling means on the car, during movement of the car along the lengthwise extent of the car supporting line.

A still further object of the invention is to provide a novel method of picking up a target object, with the toy car of the invention having grappling means thereon, responsive to manipulation of the line by an operator, to cause gravity movement of the car along the lengthwise extent of the line and to pick up and carry with it a target object.

Other objects and advantages of the invention will be apparent from the following description taken in conjunction with the accompanying drawings wherein:

DESCRIPTION OF PREFERRED EMBODIMENT

Figures 1, 2, 3, 4, 5, 6, 7, 8, 9, 10, 11:
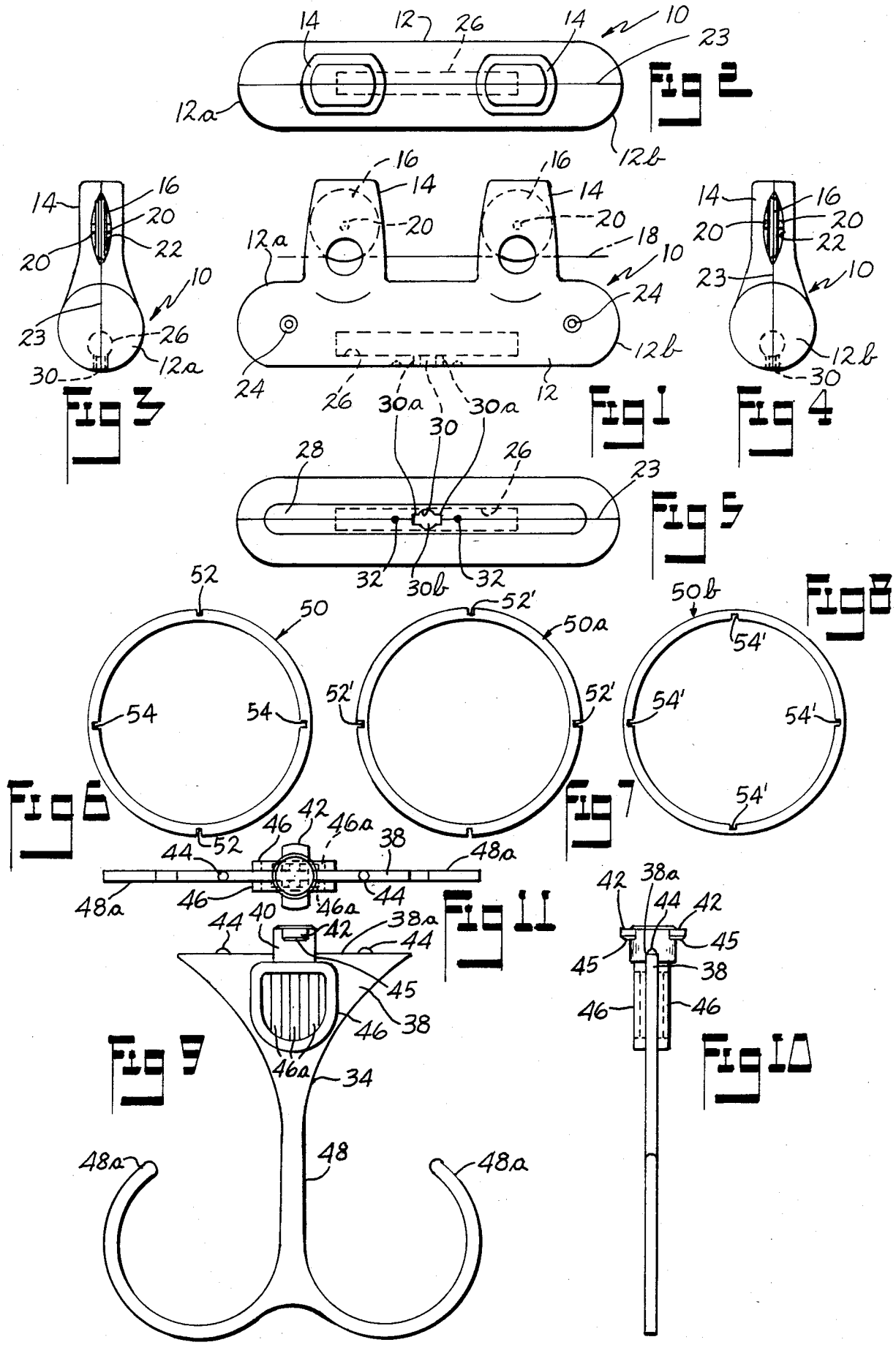
FIG. 1 is a side elevational view of a toy car formed in accordance with the invention, with means thereon for attaching a grappling means thereto.
FIG. 2 is a top plan view of the car of FIG. 1.
FIG. 3 is an end elevational view of the car of FIG. 1 taken from the lefthand end thereof.
FIG. 4 is an end elevational view of the car of FIG. 1 taken from the rightend end thereof.
FIG. 5 is a bottom plan view of the car of FIGS. 1 through 4.
FIG. 6 is an elevational view of one embodiment of rib element adapted for assembly with other rib elements in the formation of an open framework for use as a target object in connection with the picking up of the target object by the moving car.
FIG. 7 is a side elevational view of another of the ribs for use in formation of a target object.
FIG. 8 is a side elevational view of a further rib adapted for assembly with the other ribs of FIGS. 6 and 7 in the formation of an open framework for use as a target object with the toy car.
FIG. 9 is an enlarged, side elevational view of a grappling structure adapted for removable assembly with the car of FIGS. 1–5.
FIG. 10 is an end elevational view of the grappling structure of FIG. 9 taken from the righthand end thereof.
FIG. 11 is a top plan view of the grappling structure of FIGS. 9 and 10.

Referring now again to FIGS. 1–5, the toy car 10 may be formed of any suitable material, preferably plastic materials, many of which are known in the art, and comprises a body portion 12 which in the embodiment illustrated is of generally cylindrical configuration having hemispherical ends 12*a*, 12*b* thereon.

Projecting upwardly from the body 12 are a pair of turret or sail sections 14, spaced lengthwise of the car body 12, with the turret sections being generally hollow and rotatably mounting therein a respective pulley member 16 which pulley members 16 are adapted to suspend the toy car on a flexible elongated line 18 (FIG. 12) for movement of the car along the lengthwise extent of the line, responsive to manipulation of the line by an operator O.

In the embodiment illustrated, the pulleys 16 include stub axle portions 20 formed therewith, and which are rotatably mounted interiorly of the respective turret 14. The pulleys could of course be so constructed and arranged that each is rotatable relative to its respective axle, the latter being supported on the respective turret. Thus it will be seen that the pulleys 16 are rotatable relative to the respective turret section, with each of the turret sections being open as at 22 at its ends, and through which openings 22 extend the car supporting line 18, for suspending the car on the line, with the line being received within the groove in each of the pulleys.

In the embodiment illustrated, the car is molded as a two-piece affair as shown in FIGS. 2, 3 and 4 and with the lengthwise molded halves of the car being connected together along the longitudinal parting line 23 by means of suitable fasteners 24 extending between the car halves and connecting the same together.

The car body 12 is formed with a chamber or recess 26 therein which communicates with the exterior of the car body on its generally flattened or planar underside area 28 by means of an opening 30 extending upwardly into communication with chamber 26, for a purpose to be hereinafter described.

Opening 30 in the embodiment illustrated comprises lateral rectilinear shaped opening sections 30*a* communicating with the generally centrally located circular opening section 30*b*. Indentations or recessed openings 32 are preferably provided on opposite sides of the opening 30 on the underside 28 of the car and in spaced relation to the respective lateral opening section 30*a* of opening 30, for a purpose to be hereinafter described.

Figure 13:
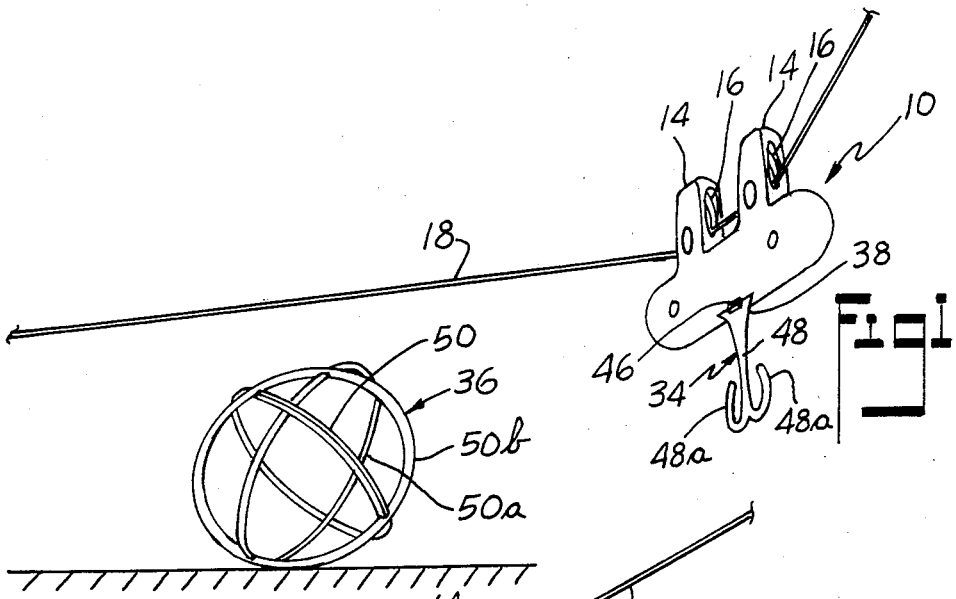
FIG. 13 is an enlarged, fragmentary illustration of the toy car of the invention as it moves along the flexible line under the influence of gravity in the direction of a target object, for grappling or picking up the same.
Figure 14:
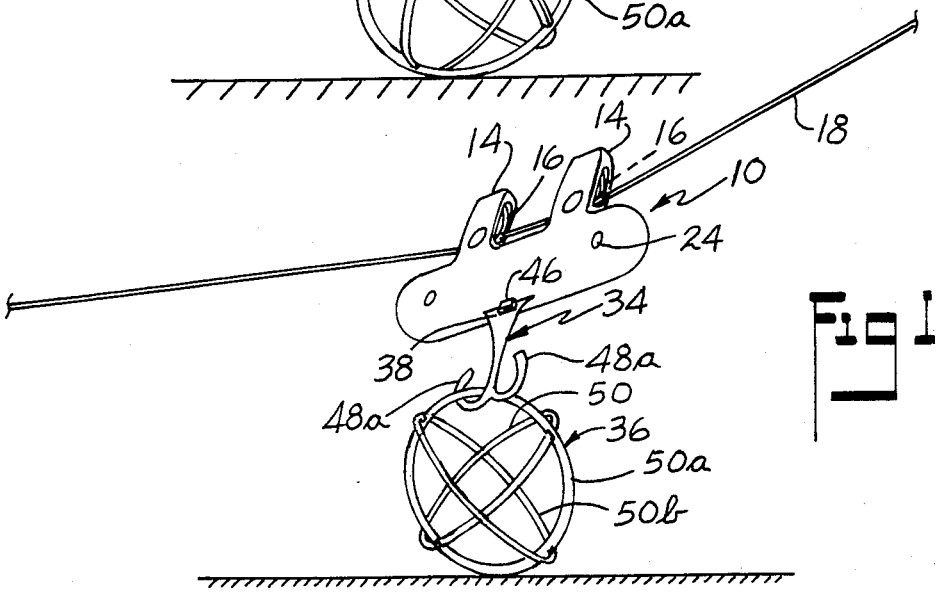
FIG. 14 is an enlarged, fragmentary view of the car of FIG. 13 as it grapples or snares the target object and commences to move the target object with the car along the lengthwise extent of the car supporting line.

Referring now to FIGS. 9–11 there is illustrated a grappling means 34 which is adapted to be attached to the car 10 for the purpose of enabling the car travelling along the lengthwise extent of the flexible line 18 to pick up and carry with it a target object 36 (FIGS. 13 and 14). Grappling means 34 in the embodiment illustrated comprises a longitudinally widened fin-like head portion 38 having a generally planar top surface 38*a*.

Projecting upwardly from the widened head portion 38 is a stud 40 of generally cylindrical configuration formed complementarily to aforementioned opening section 30*b*. Stud 40 includes laterally projecting wing portions 42 which are of a size to pass through the opening sections 30*a* of opening 30, along with the stud 40, so as to be received in the body chamber 26, which as can be seen in FIG. 5 is wider than the width of the circular portion 30*b* of opening 30. Also the head portion 38 of the grappling means 34 is preferably provided with a pair of spaced embossments or projections 44 thereon which are adapted to be received in a respective one of the recesses 32 in the flat underside surface portion 28 of the car body, when the grappling means 34 is assembled in interlocked relation on the car body. The spacing between the top surface 38*a* of the head 38 and the underside of the wing sections 42 of the stud 40 is so arranged with respect to the thickness of the bottom wall defining the chamber 26, so that when the stud 40 and wing sections 42 of the grappling means 34 are inserted into the opening 30 and rotated 90°, the wings engage the confronting underlying portions of the interior surface of the bottom wall defining the chamber 26 and the projections 44 are received in their respective recess 32, to thus snugly interlock the grappling means 34 with the car body. In this connection the lower edges of the wings 42 are preferably chamfered as at 45, for facilitating the rotation of the grappling means and associated retaining wings 42 relative to the car body.

The stud 40 and associated wing sections 42 are preferably formed on the head portion 38 of the grappling means 34 with lateral support structure 46, with such support structure including vertical strengthening ribs 46*a*. Support structure 46 facilitates the molding of the projection on the thinner head portion 38.

Depending from the head portion is an elongated stem portion 48 from which extending to either side thereof is provided a hook portion 48*a*, so that when the grappling means 34 is attached to the car as aforedescribed, each one of the hook portions 48*a* is facing toward a respective end of the car body so that the car can grapple or pick up a target object in either direction of movement along the flexible line 18.

Figure 12:
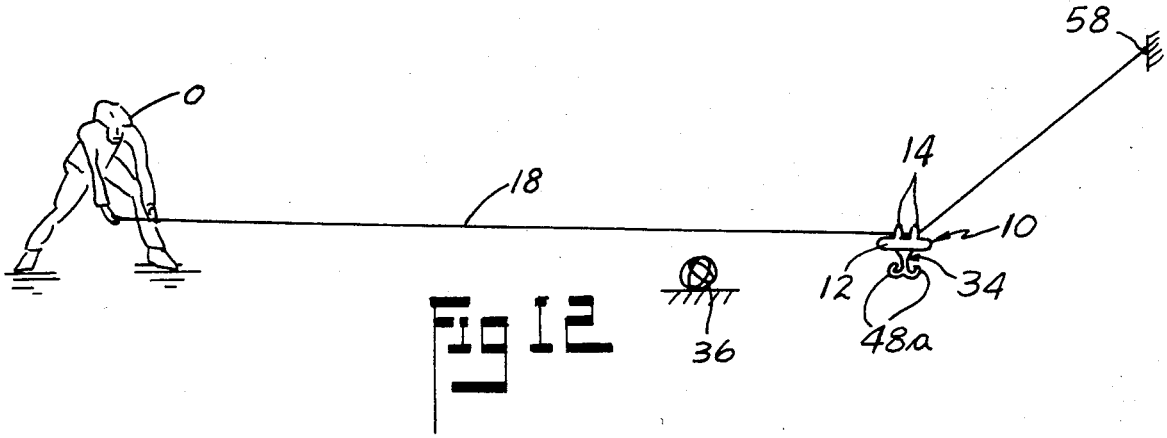
FIG. 12 is a diagrammatic illustration of a car of the invention with the grappling means thereon suspended from a flexible line, and with the line being manipulated by an operator to move the car by gravity in the direction of a target object for picking up the target object during movement of the car along the lengthwise extent of the line.

Referring to FIGS. 6–8 in conjunction with FIGS. 12 to 14, the target object in the embodiment illustrated comprises an open framework member formed from circular (in the embodiment illustrated) ribs 50, 50*a* and 50*b*. These ribs may be conveniently formed of plastic, and with the rib member 50 having peripheral slots 52 on the exterior of the rib, and interior peripheral slots 54, while the rib member 50*a* has all of its slots 52' on the exterior periphery of the rib, and with the rib member 50*b* having all of its slots 54' formed on the interior of the rib periphery.

When the ribs are assembled into the globular-like open framework structure with the notches or slots in the ribs coacting in the manner illustrated for instance in FIGS. 13 and 14, it represents a target object that can be expeditiously picked up by the car and associated grappling means travelling along the lengthwise extent of the line 18.

Referring now to FIG. 12, it will be seen that the toy car 10 is adapted to be suspended from and ride along the lengthwise extent of flexible line 18, with line 18 being conveniently anchored at one end thereof as at 58 to a support, with the other end of the line being held by an operator O and manipulated by him, so as to cause the car to travel by gravity or due to the force of gravity along the line. During such travel along the line, the car with its grappling means 34 secured thereto can be directed toward or in the direction of one of the targets 36, to see if it can be successfully picked up and carried with the car, during its movement along the line. It will be understood that when the operator raises the line by moving his arm upwardly, the car will move along the lengthwise extent of the line due to the creation of a "hill" in the line behind the racer. The car with the grappling means thereon can be directed toward a target object 36, and if the operator is skillful utilize the grappling means to pick up the target object and to carry it with the car further along the line.

The operator can create a "hill" in the line in front of the racer by moving his arm forwardly (or in a forward direction) whereby the toy car will be braked by such a "hill" causing the car to reverse itself and move in the opposite direction along the line. By maintaining a "hill" behind the car and a low level stretch of line in front of the car, the car will move by gravity in the direction of the operator, lengthwise of the line, to again provide for an attempt to pick up a target object disposed in the general path of the car. Thus the object is for the operator to hook the target object with the car and retrieve the targets as the car moves relative to the operator. A pair of operators with their individual lines can race one another to see which operator can retrieve a target, or a plurality of targets, within a predetermined time period.

It will be seen that by changing the size and arcuate configuration of the hook of the grappling means on the car, that the difficulty of hooking the open framework target object could be varied. Also by utilizing different types of targets that are either easier or less easy to grapple by means of a hook-like grappling means, the difficulty of performing the picking up operation and retrieval of the target objects can be varied. Also the types of targets utilized can be varied so that the difficulty of picking up and retrieving a target could be likewise changed or varied.

From the foregoing description and accompanying drawings it will be seen that the invention provides a novel toy car mechanism adapted to be suspended from a flexible line for movement along the lengthwise extent thereof and with the car having grappling means thereon which is adapted to pick up and carry with the car, a target object, and with the car being adapted to pick up and retrieve targets or objects from either lengthwise direction of movement of the car relative to the line.

The invention also provides a novel method for utilizing a car having a grappling means thereon and movable relative to an elongated flexible line, for picking up and retrieving a target object, with the car mechanism being adapted for use either by itself or in a competitive game with other like car mechanisms.

The terms and expressions which have been used are used as terms of description and not of limitation, and there is no intention in the use of such terms and expressions of excluding any equivalents of any of the features shown or described, or portions thereof, and it is recognized that various modifications are possible within the scope of the invention claimed.

We claim:

1. A toy car adapted for movable mounting on an elongated line comprising, a body having means secured thereto for suspending the car from an associated line, and grappling means depending from said body and adapted for picking up and retaining a target object during movement of said car along the lengthwise extent of the associated line, and wherein the underside of said body is provided with a generally planar surface and said grappling means adjacent the upper end thereof includes a widened head portion coacting in generally engaged relation with said planar surface on said body.

2. A toy car in accordance with claim 1 wherein said grappling means comprises a hook-like member.

3. A toy car in accordance with claim 2 wherein said grappling means comprises a plurality of hook-like members, said body being elongated and one of said hook-like members being oriented in a direction toward one end of said body while another of said hook-like members is oriented toward the other end of said body whereby said car is operative to pick up a target object irrespective of which direction said car is travelling on an associated line.

4. A toy car in accordance with claim 1 wherein the first mentioned means comprises a pulley-like member rotatably mounted relative to said body, and said car has a forward end and a rearward end, said grappling means comprising a plurality of hook-like members, one of said hook-like members being oriented for target object pickup in the direction of said forward end of said car while another of said hook-like members is oriented for target object pickup in the direction of the rearward end of said car, whereby said car is operative to pick up a target object irrespective of which direction said car is travelling on an associated line.

5. A toy car in accordance with claim 1 including means detachably connecting said grappling means to said body.

6. A combination in accordance with claim 1 including a target object, and wherein said target object comprises an open framework formed of a plurality of endless ribs coacting with one another in angular relationship to form said open framework, adapted for being snared by said grappling means.

7. The combination in accordance with claim 6 wherein each of said ribs are of circular configuration in side elevation, and have slots in the ribs coacting with another slotted rib member in assembled relation to provide the target object.

8. A toy car in accordance with claim 1 wherein said body comprises a cylindrical-like member having turret means projecting upwardly therefrom, the first mentioned means comprising a pulley mounted in said turret means and being accessible from the front and rearward ends thereof, for passage of the line through the turret means and into coaction with the pulley.

9. A toy car in accordance with claim 1 which is formed of plastic material and molded in half sections, and means securing said car half sections together to form the car unit.

10. A toy car adapted for movable mounting on an elongated line comprising, a body having means secured thereto for suspending the car from an associated line, and grappling means depending from said body and adapted for picking up and retaining a target during movement of said car along the lengthwise extent of the associated line, means detachably connecting said grappling means to said body, and wherein the under surface of said body includes interlocking means thereon and said grappling means includes interlocking means thereon coacting with the interlocking means on said body when said grappling means is disposed in mounted coupled relation on said body, to prevent inadvertent movement of said grappling means relative to said body.

11. A toy car in accordance with claim 10 wherein said interlocking means on said body comprises spaced openings therein and said interlocking means on said grappling means comprises projections with said projections being received in said spaced openings when said grappling means is disposed in mounted coupled relation on said body.

12. A toy car adapted for movable mounting on an elongated line comprising, a body having means secured thereto for suspending the car from an associated line, and grappling means depending from said body and including means detachably connecting said grappling means to said body, said grappling means being adapted for picking up and retaining a target object during movement of said car along the lengthwise extent of the associated line, and wherein said detachable connecting means comprises an upwardly projecting stud on said grappling means, wings extending laterally from said stud, said body having a recess therein receiving through an opening in the underside of said body the stud and wings with the wings being oriented in overlapping coacting relation with the interior of said body recess, said grappling means and associated connecting means being operative to be rotated 90 degrees whereby said wings align complementarily with said opening to permit withdrawal of said stud and wings from said recess via said opening and thus detachment of said grappling means from said body.

* * * * *